United States Patent [19]

Brockington et al.

[11] Patent Number: 4,744,837

[45] Date of Patent: May 17, 1988

[54] BRIGHT ANNEALING OF STAINLESS STEELS

[75] Inventors: James W. Brockington, Allentown; Alejandro L. Cabrera, Fogelsville; Charles G. Coe, Macungie; John F. Kirner, Allentown, all of Pa.

[73] Assignee: Air Products and Chemicals, Inc., Allentown, Pa.

[21] Appl. No.: 2,841

[22] Filed: Jan. 13, 1987

[51] Int. Cl.[4] ..... C21D 1/74

[52] U.S. Cl. ..... 148/16; 148/128; 148/16.7; 148/136

[58] Field of Search ..... 148/16, 13, 13.1, 16.6, 148/16.7, 20.3, 136, 6.3, 6.35, 6

[56] References Cited

U.S. PATENT DOCUMENTS

| | | | |
|---|---|---|---|
| 2,703,298 | 1/1955 | Branson et al. | 148/16 |
| 2,709,145 | 5/1955 | Bucknall | 148/13.1 |
| 4,210,469 | 1/1980 | Shimada et al. | 148/16 |
| 4,334,938 | 6/1982 | Shay et al. | 148/16.7 |

*Primary Examiner*—Christopher W. Brody

*Attorney, Agent, or Firm*—James C. Simmons; William F. Marsh

[57] ABSTRACT

A process for bright annealing of chromium containing alloys such as stainless steels in an atmosphere of nitrogen and hydrogen containing controlled additions of an inhibitor as described in U.S. Pat. No. 4,334,938 wherein at least one element provided at the surface of the article being annealed in an amount such that it is oxidized in preference to the chromium in said article, whereby nitrogen uptake is inhibited and dulling of the metal surface by formation of a film containing chromium oxide is avoided.

10 Claims, 3 Drawing Sheets

BRIGHT ANNEALING OF STAINLESS STEELS

FIELD OF THE INVENTION

This invention relates to the bright annealing of ferrous alloys such as stainless steels. More particularly, it relates to an improvement in the inhibited annealing of chromium containing steels as described in U.S. Pat. No. 4,334,938, issued June 15, 1982, to Shay and Ellison.

BACKGROUND OF THE INVENTION

Ferrous metal alloys become hardened and build up stresses when subjected to working such as drawing, stamping, and bending, stresses that make further working difficult. In order to remove these stresses the alloys are bright annealed by heating to an elevated temperature. Annealing must be carried out using an atmosphere which does not chemically react with the alloy either to produce discoloration by formation of oxide scale on the surface or to sensitize the alloy by forming precipitates such as nitrides in the bulk of the alloy. Such reactions are particularly troublesome in the annealing of chromium containing alloys.

Pure hydrogen or dissociated ammonia have previously been used as atmospheres for bright annealing. Pure hydrogen works well, but it is more expensive than many other gas compositions. Dissociated ammonia is cheaper, but subject to quality control problems when the catalyst used to generate the atmosphere by decomposition of the ammonia operates at less than maximum efficiency, since it is believed that residual ammonia can cause undesirable nitriding of some steels being annealed.

More recently, cheaper hydrogen/nitrogen blends containing high levels of nitrogen have been investigated. The high levels of nitrogen in the gas atmosphere lead to unacceptably high levels of nitriding of some steel alloys which results in precipitation of metal nitrides and subsequent loss in corrosion resistance of the part. As reported by N. K. Koebel ("Iron and Steel Engineer", July 1964, p. 81, and "Heat Treating", December 1977, p. 14) and by others, the addition of water vapor to the atmoxphere in small amounts can partially inhibit the nitrogen uptake to keep nitriding levels below unacceptable limits. A more practical approach to the addition of oxygen-containing inhibitors to the gas atmosphere is the addition of a gas, such as nitrous oxide or carbon dioxide, the level of which may be controlled, e.g., as described in U.S. Pat. No. 4,334,938, issued June 15, 1982.

Although oxygen-containing compounds have been used to inhibit nitrogen uptake, care is required to prevent discoloration of stainless steel parts through excessive oxidation of chromium. The equilibrium oxidation-reduction boundaries for chromium in any alloy may be utilized as a guide to prevent excessive oxidation, as described by Ellison, et al. in "Metal Progress", June 1983, p. 39. However, as noted in that article the optimum atmosphere for each stainless steel type must still be determined empirically to find the oxidant/hydrogen ratio which inhibits nitrogen uptake and gives acceptable surface appearance. For those alloys containing strong nitride formers such as Ti, only hydrogen without nitrogen has been used because of the fear of sensitizing the alloy by forming nitrides in the bulk.

U.S. Pat. No. 4,334,938 describes a process for limiting the absorption of nitrogen by ferrous metal containing chromium as an alloying additive (e.g. stainless steel) during high temperature annealing in an atmosphere of nitrogen and hydrogen by controlled additions of an inhibitor selected from the group consisting of water vapor, oxygen, nitrous oxide, carbon dioxide or mixtures thereof to the atmosphere while controlling the dew point of the furnace atmosphere and/or the ratio of the partial pressure of the inhibitor to the partial pressure of the hydrogen.

BRIEF DESCRIPTION OF THE INVENTION

The present invention is an improved process for annealing ferrous alloys containing low levels of easily oxidized elements and strong nitride formers in hydrogen/nitrogen atmospheres whereby nitrogen uptake is inhibited and sensitization is prevented without dulling the metal surface.

DETAILED DESCRIPTION OF THE INVENTION

Figure 1:
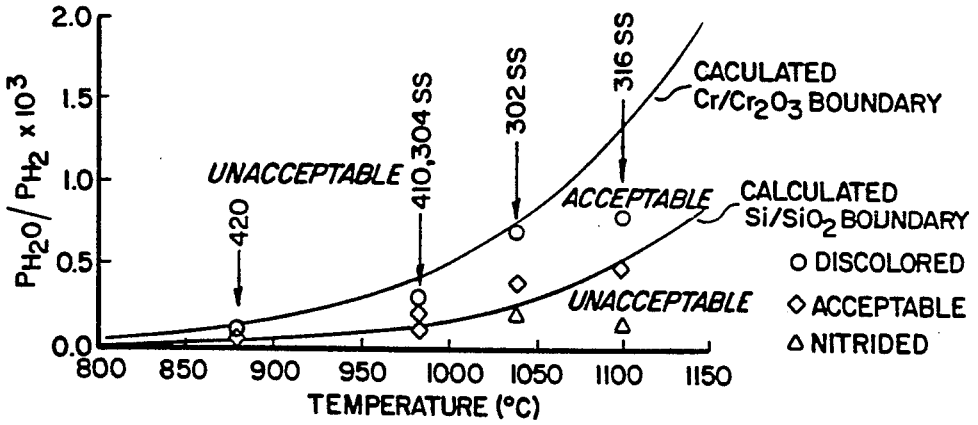
FIG. 1 contains plots of calculated redox boudaries for 18% Cr and 1.5 mol% Si in an austenitic stainless steel as a function of $H_2O/H_2$ molar ratios and temperature. It also depicts the surface appearance of stainless steel samples annealed at specific $H_2O/H_2$ ratios and temperature.

It has now been found that the process described in Shay, et al. U.S. Pat. No. 4,334,938 may be more readily practiced industrially if an element is provided which forms an oxide on the surface of the artile being annealed, the amount of said oxide being insufficient to noticeably dull the finish of the article being annealed but being sufficient to prevent the absorption of nitrogen by the article being annealed. Suitable elements for this purpose are those which oxidize more readily than Cr in the inhibited nitrogen/hydrogen atmospheres described by Shay, et al. in U.S. Pat. No. 4,334,938, and include Si, Ti, Al, Nb, Ta, B, Zr, Y, V and Mn, with Si being particularly preferred.

The protective element may be provided in the body of the article from which it may diffuse to the surface and there form the protective superficial coherent oxide film, or it may be applied as an extremely thin coating to the article, e.g. by chemical vapor deposition, sputtering or by any other known technique. The coating may be applied prior to annealing or the element may be provided in the annealing atmosphere.

If the element is present in the alloy constituting the article being annealed, the oxidizing potential of the atmosphere (as defined by the water/hydrogen molar ratio at equilibrium in the gas phase) must be such that it is oxidizing to the most easily oxidized component of the alloy based on the activities of the elements in the alloy and such that the formation of the oxide of that component is favored over the formation of the nitride of that component, but such that the atmosphere is reducing to Cr thus avoiding formation of a dulling film of $Cr_2O_3$.

Briefly stated, the present invention is an improved process for annealing ferrous alloys in hydrogen/nitrogen atmospheres wherein nitrogen uptake is inhibited without dulling the metal suface conprising the addition of small amounts of oxygen-containing compounds such as water vapor, oxygen oxides of carbon, oxides of nitrogen or mixtures thereof in order to maintain the oxidizing potential of the atmosphere—as defined by the water/hydrogen molar ratio at equilibrium in the gas phase—such that it is oxidizing to the protective element (silicon or other element) based on the activity of said element in the specific alloy whereby a dulling film of $Cr_2O_3$ does not form on the surface of the work being annealed.

The invention is applicable to a wide variety of ferrous alloys such as types 302, 310, 321, 347 and other stainless steels, aluminum killed steels, and any other steels containing one or more easily oxidized element such as Ti, Nb, Al, Ta, B, Zr, Y, V, Mn, Si, or the like, using a water/hydrogen ratio based on the activity of the easily oxidized element in the alloy. In the description which follows the invention will be illustrated with Si, Mn and Nb as the protective elements, but it is equally applicable to steels utilizing other elements than silicon as the protective element.

For purposes of illustration the derivation of an expression of the $H_2O/H_2$ molar ratio for inhibiting nitrogen uptake as a function of temperature and silicon content of a ferrous alloy is set forth in the following mathematical presentation using the free energies of formation of $SiO_2$ and $H_2O$ published in Kubachewski and Allcock "Metallurgical Thermochemistry", 5th Edition, Pergamon Press (New York) 1979 and the expression for the activity of Si in Fe is that reported in Yamazaki, T., et al., Tetsuto Hagane 69 (1) 126–35 (1983) [CA: 98(12)93591e]. In the derivation $a_{Si}$ represents the activity of Si and $X_{si}$ represents the mole fraction of Si.

Derivation of Expression of $H_2O/H_2$ Molar Ratio for Inhibiting Nitrogen Uptake as a Fuction of Temperature and Si Content of Ferrous Alloys (a) $H_2/H_2O$ Molar Ratio for dissolved silicon in equilibrium with $SiO_2$ $$[Si]_{Fe} + 2H_2O = SiO_2 + 2H_2 \quad (1)$$

$$K_{eq} = \frac{P^2_{H2}}{P^2_{H2O} \cdot a_{Si}} \text{ since } a_{SiO2} = 1 \quad (2)$$

$$\Delta G^\circ_{RXN} = -RT\ln K_{eq} \quad (3)$$

$$\Delta G^\circ_{RXN} = \Delta G^\circ_f(\text{Products}) - \Delta G^\circ_f(\text{Reactants}) \quad (4)$$

$$= \Delta G^\circ_f(SiO_2) + 2\Delta G^\circ_f(H_2) - 2\Delta G^\circ_f(H_2O) - \Delta G^\circ_f(Si) \quad (5)$$

$$= (-215600 + 41.5 \cdot T) + 0 + (117800 - 26.2 \cdot T) - 0 \quad (6)$$

$$= -97800 + 15.3 \cdot T \text{ (cal/mole)} \quad (7)$$

combining (2) and (3)

-continued $$\frac{P^2_{H2}}{P^2_{H2O} \cdot a_{Si}} = \exp\left[\frac{-\Delta G^\circ_{RXN}}{R \cdot T}\right] \quad (8)$$

combining (7) and (8)

$$\frac{P_{H2}}{P_{H2O}} = \left\{a_{Si} \cdot \exp\left[\frac{97800 - 15.3 \cdot T}{1.987 \cdot T}\right]\right\}^{\frac{1}{2}} \quad (9)$$

$$a_{Si} = (\chi_{Si}) \cdot \text{antilog}\,[-4540/T - 0.549] \quad (10)$$

$$= (\chi_{Si}) \cdot \exp\,[2.303 \cdot (-4540/T - 0.549)]$$

combining (9) and (10)

$$\frac{P_{H2}}{P_{H2O}} = \left\{(\chi_{Si}) \cdot \exp\left[\frac{-10456}{T} - 1.264\right] \cdot \exp\left[\frac{97800 - 15.3 \cdot T}{1.987 \cdot T}\right]\right\}^{\frac{1}{2}} \quad (11)$$

$$= \left\{(\chi_{Si}) \cdot \exp\left[\frac{-10456}{T} - 1.264 + \frac{49220}{T} - 7.7\right]\right\}^{\frac{1}{2}} \quad (12)$$

$$= \left\{(\chi_{Si}) \cdot \exp\left[\frac{38764}{T} - 8.964\right]\right\}^{\frac{1}{2}}$$

(b) $H_2O/H_2$ Molar Ratio for inhibiting nitrogen uptake $$\frac{P_{H2O}}{P_{H2}} \geqq \left\{(\chi_{Si}) \cdot \exp\left[\frac{38764}{T} - 8.964\right]\right\}^{-\frac{1}{2}} \quad (13)$$

Similar expressions may be derived for Al, Ti and other elements which are provided to inhibit nitrogen pickup when practicing the bright annealing process of the present invention.

The calculated equilibrium $H_2O/H_2$ ratios for oxidation of Cr and Si are plotted as solid curves in FIG. 1 as a function of temperature for a typical stainless steel, e.g. 18% Cr and 1.5 mole% Si. Annealing in $H_2/N_2$ atmospheres under conditions which lie between these two curves gives acceptable results. Annealing under conditions which lie above the 18% $Cr/Cr_2O_3$ redox line results in discoloration or dulling. Annealing under conditions which lie below the 1.5% $Si/SiO_2$ redox line results in unacceptable nitriding.

Commercial annealing results for types 304, 316, 410 and 420 stainless steels as well as experimental laboratory annealing results for type 302 stainless steel are plotted in FIG. 1. Diamonds represent acceptable samples, circles represent discolored samples, and triangles represent nitrided samples. The agreement between predicted and observed values is very good. The data show trends in nitrogen uptake (corrosion resistance) and suface oxidation (discoloration or dulling), not abrupt disontinuities. The fact that some data points for discolored parts lie below the 18% $Cr/Cr_2O_3$ redox boundary appears to be due to the oxidation that occurs during cooling of the metal part through regimes at which the $H_2O/H_2$ ratio, which was not oxidizing to Cr at the annealing temperature, is now oxidizing and the temperature is still high enough for rates of oxidation to be significant.

Figure 2:
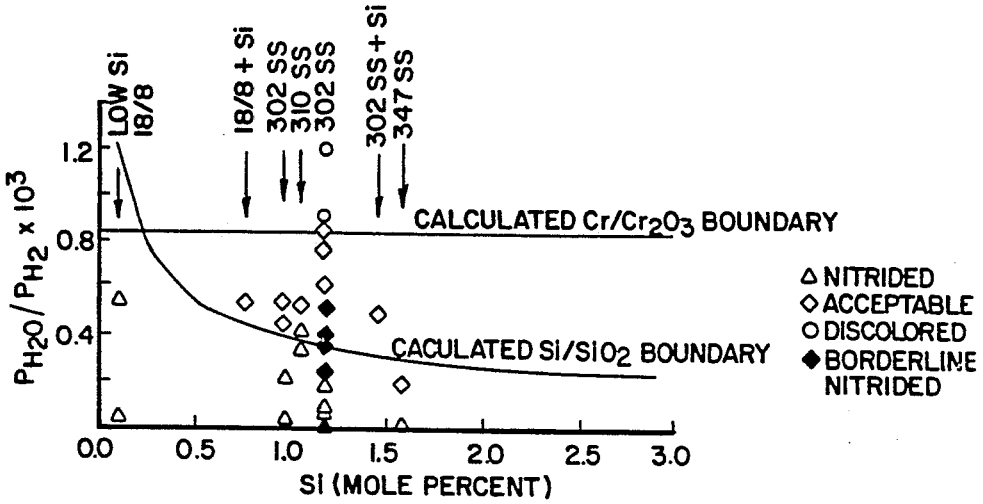
FIG. 2 contains a similar plot of calculated $H_2O/H_2$ ratios as a function of the silicon content for annealing at 1050° C. Experimental data is also included.

The algebraic expression that defines the minimum $H_2O/H_2$ ratios for inhibiting nitrogen uptake is plotted as a function of Si content of the steel for a specific annealing temperature of 1050° C. in FIG. 2. As in FIG. 1, annealing conditions which lie above the $Si/SiO_2$ equilibrium line are predicted to give inhibition of nitrogen uptake by virtue of formation of an $SiO_2$ surface film and result in an acceptable annealed part. The equilibrium $H_2O/H_2$ ratio for 18% $Cr/Cr_2O_3$ at 1050° C. is also indicated in FIG. 2. Again, annealing conditions which lie above this line are predicted to result in discoloration or dulling by virtue of formation of a $Cr_2O_3$ scale.

Experimental laboratory annealing results in $H_2/N_2$ atmospheres at 1040° C. for austenitic stainless steels with analyzed Si contents are also plotted in FIG. 2. Samples considered acceptable picked up less than 0.3 wt% nitrogen as determined by in situ microgravimetry on exposure of metal foils to the $H_2/N_2$ annealing atmosphere and are plotted as diamonds. Unacceptably nitrided samples with >0.3 wt% nitrogen uptake are plotted as triangles. Discolored samples are plotted as circles. As in FIG. 1, the agreement between predicted and observed values in FIG. 2 is very good.

Figure 3:
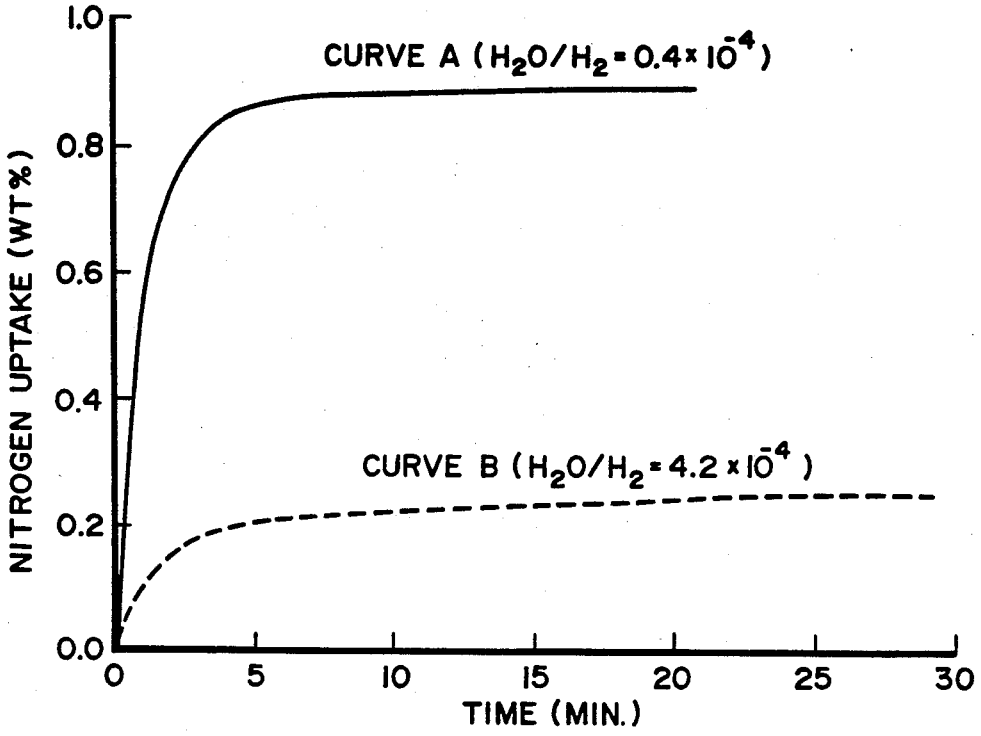
FIG. 3 is a graph showing nitrogen uptake by type 302 stainless steel as a function of time, when annealed at 1040° C. in 70% $N_2$/30% $H_2$ atmospheres with two different moisture contents.

FIG. 3 depicts nitrogen uptake curves for 302 SS (an 18% Cr/8% Ni/bal.Fe alloy containing approximately 0.4 wt% Si) foils on exposure to 70% nitrogen/30% hydrogen simulated annealing atmospheres at 1040° C. Curve A displays uptake in a dry atmosphere (water/hydrogen ratio less than $0.4\times10^{-4}$), when the sample is exposed to an atmosphere containing water at a water/hydrogen ratio $4.2\times10^{-4}$ Curve B is obtained. Nitrogen uptake is slowed relative to the initial rate in the dry atmosphere, and stops at a level below that in equilibrium with the gas phase.

Figure 5:
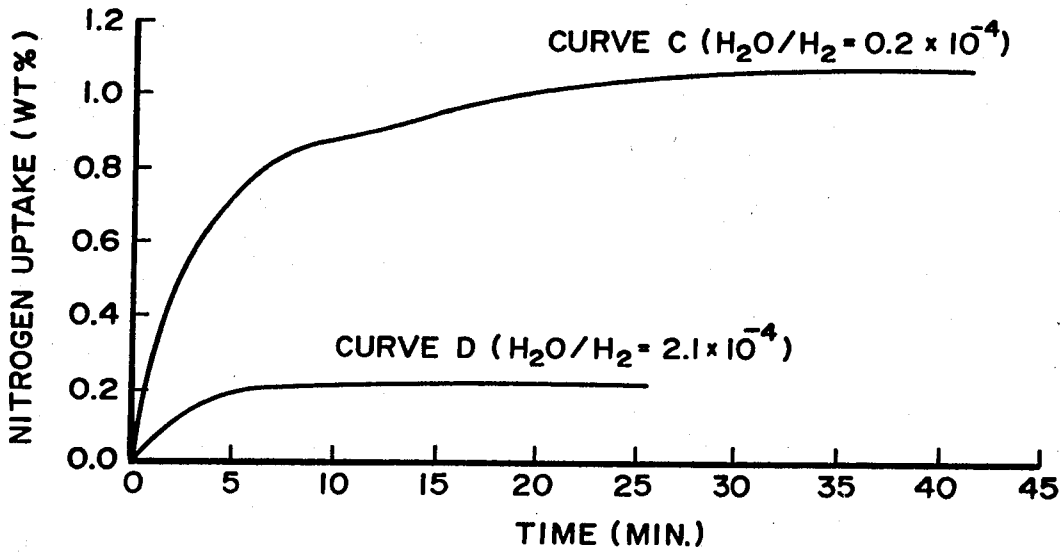
FIG. 5 is a plot like FIG. 3 for 347 stainless steel.

FIG. 5 depicts nitrogen uptake curves for 347 SS (an 18% Cr/10% Ni/bal.Fe alloy containing approximately 0.7 wt% Ta+Nb) foil on exposure to 70% nitrogen/30% hydrogen simulated annealing atmospheres at 1040° C. Curve C displays uptake in a dry atmosphere (water/hydrogen ratio less than $0.2\times10^{-4}$) which rises rapidly and levels off at about 1% when nitrogen in the bulk comes to equilibrium with nitrogen in the gas phase. When a sample is exposed to an atmosphere containing water at a water/hydrogen ratio of $2.1\times10^{-4}$, Curve D is obtained. Nitrogen uptake is slowed relative to the initial rate in the dry atmosphere, and stops at a level below that in equilibrium with the gas phase.

Figure 4:
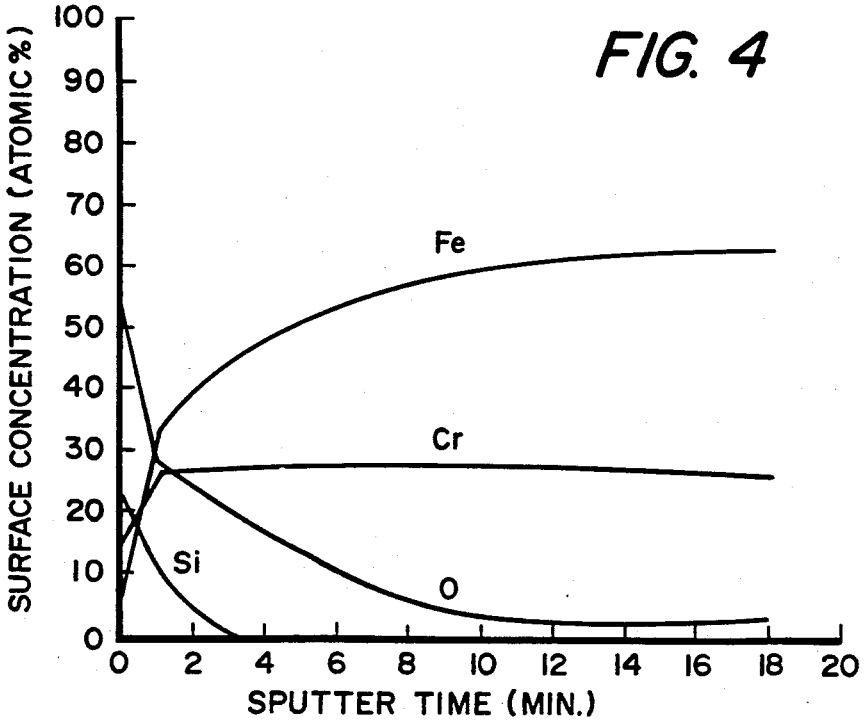
FIG. 4 is a plot showing the depth profile for various elements as determined by Auger electron spectroscopy for a sample annealed at 1040° C. in 70% $N_2$/30% $H_2$ at a dew point of −40° C.

Table 1 contains surface compositions as determined by X-ray Photelectron Spectroscopy (XPS) of typical samples at the end of runs in dry (Curve A) and wet (Curve B) atmospheres. For the 302SS sample exposed to a wet nitrogen/hydrogen atmosphere in which nitrogen uptake was inhibited, Si is observed as the major metallic component of the surface. A depth profile for a 302SS sample at the end of Curve B using argon ion sputtering and Auger Electron Spectroscopy (AES) is shown in FIG. 4. Using a sputter rate of 35 Å/min the film is determined to be about 100 Å thick. For the sample exposed to the dry atmosphere, no surface Si enrichment is observed by X-ray Photoelectron Spectroscopy. (See Table 1, Curve A).

TABLE 1

XPS Surface Composition After Annealing in Wet $H_2/N_2$ Atmospheres

| Steel | Sample | Element (atomic %) | | | | | | | | |
|---|---|---|---|---|---|---|---|---|---|---|
| | | C | N | O | Si | Mn | Cr | Fe | Ni | Nb |
| 302SS | Curve A | 39.7 | 3.6 | 38.3 | 0.4 | — | 8.1 | 8.7 | — | — |
| 302SS | Curve B | 16.6 | 0.5 | 55.7 | 23.2 | — | 3.7 | 0.3 | — | — |
| 347SS | Curve D | 15.30 | 6.1 | 48.7 | 15.40 | 3.60 | 9.4 | — | — | 1.60 |
| 347SS | Bulk (wt %) | 0.8 | — | — | 0.81 | 1.431 | 18.0 | 71.2 | 10 | .66 |

Table 1 contains surface compositions as determined by XPS of the 347SS sample at the end of run D (FIG. 5). For the sample exposed to a wet nitrogen/hydrogen atmosphere in which nitrogen uptake was inhibited, the easily oxidized elements Si, Mn and Nb are the major metallic components of the surface oxide film, summing to 21 atomic % vs. 9% for Cr. The Cr binding energy (B.E.) suggests that the Cr which is observed is present as $Cr_2N$, not $Cr_2O_3$.

Annealing in $H_2/N_2$ atmospheres under conditions which lie between the two calculated curves in FIG. 1 should give acceptable results. Annealing under conditions which fall above the $Cr/Cr_2O_3$ redox line will result in discoloration or dulling of the steel due to the formation of an oxide scale. Annealing under conditions which fall below the $Si/SiO_2$ redox line (FIG. 1) result in undesirable nitriding. Of course care must be taken to avoid discoloration (or nitriding during the initial heating) during the terminal cooling of the parts being annealed.

As indicated above, similar algebraic expressions can be derived which define acceptable operating regimes for those steels which are susceptible to bulk nitriding and which predict absence of both bulk nitriding and surface oxidation. For example, the minimum $H_2O/H_2$ ratio required to form $TiO_2$ from Ti dissolved in the alloy is defined by the folowing expression:

$$\frac{P_{H2O}}{P_{H2}} \geqq X_{Ti}^{\frac{1}{2}} \cdot \exp\left[-23077/T + 4.696\right].$$

The minimum $H_2O/H_2$ ratio required to prevent formation of TiN by formation of $TiO_2$ is defined by the following expression:

$$\frac{P_{H2O}}{P_{H2}} \geqq P_{N2}^{\frac{1}{4}} \cdot \exp\left[-6755/T - 1.5\right].$$

In order to inhibit nitrogen uptake by the formation of a $TiO_2$ passive film, both the above conditions must hold. If the $H_2O/H_2$ ratio required to prevent TiN formation is also oxidizing to Cr in the alloy, it is still possible to find an operable regime by lowering the $N_2$ content of the $H_2/N_2$ annealing atmosphere and/or by raising the annealing tempreature.

In general commonly used temperature and times are employed in carrying out the present invention, it merely being necessary to operate in the region between that which produces a dulling film of chromium oxide and that which results in an unacceptable nitrogen pickup.

With silicon as the protective element, the preferred annealing would be for 5 minutes to 2 hours at temperatures 900°–1150° C., but the process may be carried out for times between one minute and 20 hours and at temperatures between 500° C. and 1300° C. The duration of the annealing is such that a film of $SiO_2$ between 50 and 300 Å thick is formed.

Having thus described our invention what is desired to be secured by Letters Patent of the United States is set forth in the appended claims.

We claim:

1. In a process for bright annealing of chromium containing ferrous alloys in an atmosphere of nitrogen and hydrogen containing controlled additions of an inhibitor elected from the group consisting of water vapor, oxygen, oxides of nitrogen, oxides of carbon and mixtures thereof while controlling the dewpoint of the furnace atmosphere and/or the ratio of the partial pressure of the inhibitor to the oartial pressure of hydrogen in said atmosphere, the improvement which conprises providing at least one element which oxidizes more readily than Cr at the surface of the article to be annealed in an amount such that it is oxidized in preference to the Cr in said article and controlling the ratio of the partial pressure of the inhibitor to the partial pressure of the hydrogen in the furnace atmosphere as a function of the temperature and the content of said element, whereby nitrogen uptake is inhibited and dulling the metal surface by formation of a film containing chromium oxide on said surface is avoided.

2. The process of claim 1 wherein the oxidizable element is selected from the group consisting of Si, Ti, Nb, Al, Ta, Mn, B, Zr, Y, V and mixtures thereof.

3. The process of claim 1 wherein the oxidizable element is Si.

4. The process of claim 1 wherein the oxidizable element is in the bulk alloy of article being treated.

5. The process of claim 1 wherein the oxidizable element is present as a coating applied to the article being treated.

6. The process of claim 1 wherein the furnace atmosphere is oxidizing to said element but is reducing to Cr based on the activities of said element and of Cr in said article, and such that formation of the oxide of said element is favored over the formation of the nitride of said element.

7. The process of claim 1 wherein said alloy is a stainless steel.

8. The process of claim 1 wherein the annealing is performed at temperatures between about 500° C. and 1300° C.

9. The process of claim 3 wherein the inhibitor is $H_2O$ and the ratio of $H_2O$:$H_2$ for inhibiting nitrogen uptake as a function of temperature and silicon content at the surface of said article is expressed by the equation $$\frac{P_{H2O}}{P_{H2}} \geqq \left\{ (X_{Si}) \cdot \exp\left[ \frac{38764}{T} - 8.964 \right] \right\}^{-\frac{1}{2}}$$

wherein $X_{Si}$ is the mole fraction of Si.

10. The process of claim 1 wherein the inhibitor is $H_2O$ and the ratio of $H_2O$ to $H_2$ for a given atmosphere is proportioned according to the amount of said element provided at the surface of said article.

* * * * *